US010975878B2

(12) United States Patent
Ozasa et al.

(10) Patent No.: US 10,975,878 B2
(45) Date of Patent: Apr. 13, 2021

(54) ROTARY MACHINE

(71) Applicant: IHI Corporation, Koto-ku (JP)

(72) Inventors: Takuya Ozasa, Koto-ku (JP); Ryosuke Yumoto, Koto-ku (JP)

(73) Assignee: IHI Corporation, Koto-ku (JP)

( * ) Notice: Subject to any disclaimer, the term of this patent is extended or adjusted under 35 U.S.C. 154(b) by 134 days.

(21) Appl. No.: 16/080,182

(22) PCT Filed: Feb. 20, 2017

(86) PCT No.: PCT/JP2017/006184
§ 371 (c)(1),
(2) Date: Aug. 27, 2018

(87) PCT Pub. No.: WO2017/150254
PCT Pub. Date: Sep. 8, 2017

(65) Prior Publication Data

US 2019/0055953 A1 Feb. 21, 2019

(30) Foreign Application Priority Data

Mar. 3, 2016 (JP) ..... 2016-041068

(51) Int. Cl.
*F04D 29/053* (2006.01)
*F04D 29/28* (2006.01)
(Continued)

(52) U.S. Cl.
CPC ..... *F04D 29/053* (2013.01); *F04D 29/056* (2013.01); *F04D 29/28* (2013.01);
(Continued)

(58) Field of Classification Search
CPC ..... F04D 29/053; F04D 29/054; F04D 29/02; F04D 29/266; F04D 29/624; F04D 29/284
See application file for complete search history.

(56) References Cited

U.S. PATENT DOCUMENTS 3,061,342 A * 10/1962 Feller ..... F01D 5/025 403/15
3,604,819 A * 9/1971 Krahe ..... C21D 9/673 416/204 R
(Continued)

FOREIGN PATENT DOCUMENTS

CN 102852968 A 1/2013
CN 106050654 A 10/2016
(Continued)

OTHER PUBLICATIONS

International Search Report dated Apr. 18, 2017 in corresponding PCT/JP2017/006184.

*Primary Examiner* — Nathaniel E Wiehe
*Assistant Examiner* — Jackson N Gillenwaters
(74) *Attorney, Agent, or Firm* — Oblon, McClelland, Maier & Neustadt, L.L.P.

(57) ABSTRACT

Provided is a rotary machine including a rotating resinous impeller, a rotary shaft penetrating the impeller, and a fastening portion screwed to the rotary shaft, in which the rotary shaft includes a penetrating shaft portion facing an inner peripheral surface of the impeller, a tip shaft portion screwed to the fastening portion, and a fastening reception portion sandwiching the impeller between the fastening reception portion and the fastening portion, the penetrating shaft portion has a non-circular portion and an outline of a cross section of the non-circular portion orthogonal to a rotational axis deviates from a perfect circle about the rotational axis, and the impeller includes a connecting portion engaging with the non-circular portion.

8 Claims, 10 Drawing Sheets

(51) Int. Cl.
*F04D 29/056* (2006.01)
*F04D 29/62* (2006.01)
*F01D 25/16* (2006.01)

(52) U.S. Cl.
CPC ..... *F04D 29/284* (2013.01); *F04D 29/624* (2013.01); *F01D 25/162* (2013.01)

(56) References Cited

U.S. PATENT DOCUMENTS

| | | | | |
|---|---|---|---|---|
| 3,670,382 | A * | 6/1972 | Keehan | B29C 70/04 29/889.4 |
| 10,119,411 | B2 * | 11/2018 | Dimova | F02C 6/12 |
| 10,227,992 | B2 * | 3/2019 | Boening | F01D 5/025 |
| 2004/0131469 | A1 | 7/2004 | Billington | |
| 2005/0191178 | A1 * | 9/2005 | Watkins | F04D 29/20 415/216.1 |
| 2010/0098532 | A1 * | 4/2010 | Diemen | F04D 27/02 415/203 |
| 2011/0091323 | A1 * | 4/2011 | Koike | F04D 29/665 416/175 |
| 2013/0004348 | A1 | 1/2013 | Sugiyama et al. | |
| 2015/0030481 | A1 | 1/2015 | Sugiyama et al. | |
| 2016/0169242 | A1 | 6/2016 | Sugiyama et al. | |
| 2016/0273545 | A1 | 9/2016 | Hayashi et al. | |
| 2017/0114792 | A1 * | 4/2017 | Furusawa | F04D 29/043 |
| 2018/0029273 | A1 * | 2/2018 | Okabe | B29C 45/73 |

FOREIGN PATENT DOCUMENTS

| | | | |
|---|---|---|---|
| EP | 3 081 746 | A1 | 10/2016 |
| JP | 49-113205 | U | 9/1974 |
| JP | 52-116707 | U | 9/1977 |
| JP | 62-121900 | A | 6/1987 |
| JP | 63-130696 | | 8/1988 |
| JP | 63-183434 | | 11/1988 |
| JP | 1-158525 | | 11/1989 |
| JP | 2-139334 | | 11/1990 |
| JP | 5-21200 | U | 3/1993 |
| JP | 5-79346 | | 3/1993 |
| JP | 10-311222 | | 11/1998 |
| JP | 2000-291441 | | 10/2000 |
| JP | 2002-276594 | | 9/2002 |
| JP | 2004-144095 | A | 5/2004 |
| JP | 2005-291152 | | 10/2005 |
| JP | 2005-330816 | | 12/2005 |
| JP | 2009-209731 | | 9/2009 |
| JP | 2009-228446 | | 10/2009 |
| WO | WO 2015/087414 | A1 | 6/2015 |

* cited by examiner (a)

(b)

(a)

(b)

(c)

(a)

(b)

ROTARY MACHINE

TECHNICAL FIELD

The present disclosure relates to a rotary machine provided with a rotating impeller.

BACKGROUND ART

A rotary machine provided with a resinous impeller is known. For example, in the rotary machine that is disclosed in Patent Literature 1, an impeller is attached to a turbine shaft by the turbine shaft penetrating a hub portion of the impeller and tightening being performed by a nut being screwed to a protruding end of the turbine shaft.

CITATION LIST

Patent Literature

Patent Literature 1: Japanese Unexamined Utility Model Publication No. H1-158525

SUMMARY OF INVENTION

Technical Problem

In the rotary machine according to the related art, creep deformation is likely to occur in the impeller with time in a case where the impeller fastened with the nut is made of resin. Accordingly, once the creep deformation in the impeller increases depending on operation situations, the magnitude of the nut fastening force, or the like, the fastening force for holding the impeller may be reduced and rotation of the impeller may become unstable.

The present disclosure describes a rotary machine suitable for stably maintaining the rotation of a resinous impeller.

Solution to Problem

An aspect of the present disclosure relates to a rotary machine including a rotating resinous impeller, a rotary shaft penetrating the impeller, and a fastening portion screwed to the rotary shaft, in which the rotary shaft includes a penetrating shaft portion facing an inner peripheral surface of the impeller, a tip shaft portion screwed to the fastening portion, and a fastening reception portion sandwiching the impeller between the fastening reception portion and the fastening portion, the penetrating shaft portion has a non-circular portion and an outline of a cross section of the non-circular portion orthogonal to a rotational axis deviates from a perfect circle about the rotational axis, and the impeller includes a connecting portion engaging with the non-circular portion.

Effects of Invention

According to several aspects of the present disclosure, rotation of a resinous impeller is stably and suitably maintained.

DESCRIPTION OF EMBODIMENTS

Figure 1:
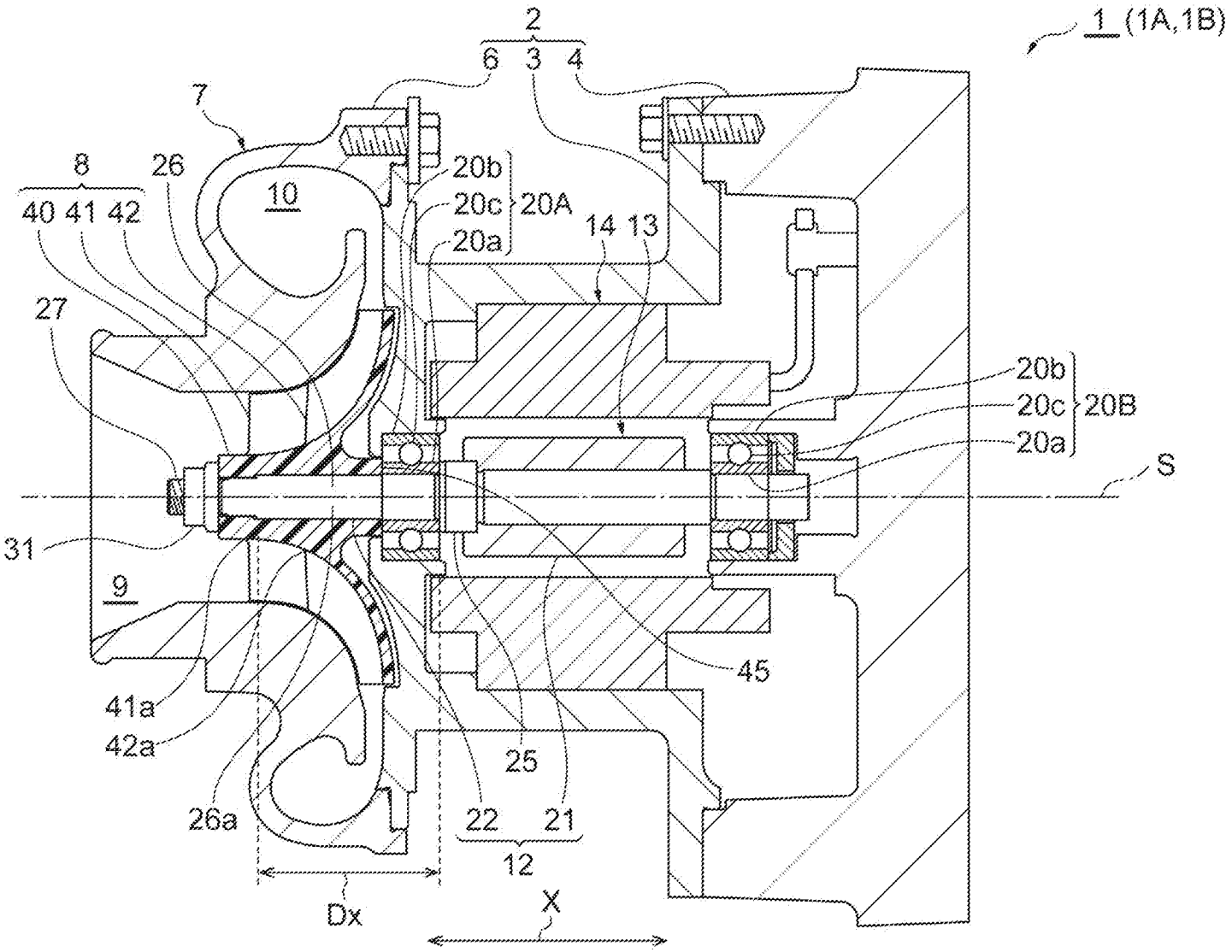
FIG. 1 is a cross-sectional view of an electric supercharger according to an embodiment of the present disclosure.

An aspect of the present disclosure relates to a rotary machine including a rotating resinous impeller, a rotary shaft penetrating the impeller, and a fastening portion screwed to the rotary shaft, in which the rotary shaft includes a penetrating shaft portion facing an inner peripheral surface of the impeller, a tip shaft portion screwed to the fastening portion, and a fastening reception portion sandwiching the impeller between the fastening reception portion and the fastening portion, the penetrating shaft portion has a non-circular portion and an outline of a cross section of the non-circular portion orthogonal to a rotational axis deviates from a perfect circle about the rotational axis, and the impeller includes a connecting portion engaging with the non-circular portion.

In the present aspect, the non-circular portion of the penetrating shaft portion and the connecting portion of the impeller engage with each other and a rotational force is transmitted once the rotary shaft rotates. In other words, the impeller is capable of receiving a rotational force from the non-circular portion and the connecting portion engaging with each other as well as the fastening portion. This engagement between the non-circular portion and the connecting portion is a relationship of mutual engagement in the rotational direction of the rotary shaft and the impact of creep deformation generated by fastening of the fastening portion is unlikely to be received. As a result, the rotational force from the rotary shaft is transmitted to the impeller via the non-circular portion and the connecting portion even if creep deformation occurs in the resinous impeller, and thus idling of the resinous impeller can be prevented, which is suitable for stably maintaining rotation and advantageous for service life extension.

In the rotary machine according to several possible aspects, a plurality of locking portions deviating from the perfect circle are disposed in the non-circular portion, the plurality of locking portions are disposed at regular intervals in a circumferential direction of the rotary shaft, a plurality of locking reception portions respectively engaging with the plurality of locking portions are disposed in the connecting portion, and the plurality of locking reception portions are disposed at regular intervals in the circumferential direction of the rotary shaft. By the plurality of locking portions and the plurality of locking reception portions being disposed at regular intervals in the circumferential direction of the rotary shaft, an increase in unbalance amount as a rotating body can be reduced and an increase in whirling amount attributable to rotational eccentricity can be prevented. As a result, rotation of the impeller is stably and suitably maintained.

In the rotary machine according to several possible aspects, the impeller includes a hub portion surrounding the penetrating shaft portion and a plurality of long blade portions and a plurality of short blade portions disposed on an outer periphery of the hub portion and alternately disposed along a circumferential direction of the rotary shaft, the penetrating shaft portion has a cylindrical main circular portion disposed closer to the fastening reception portion side than the non-circular portion with an outer periphery in contact with the hub portion, and the main circular portion extends at least from an end portion of the hub portion on the fastening reception portion side to a position beyond the short blade portion. The long blade portion also is disposed, to alternate in the circumferential direction of the rotary shaft, at the part of the hub portion where the short blade portion is disposed, and the part where the short blade portion and the long blade portion are alternately disposed can also be referred to as the core part of the hub portion. With the main circular portion according to the present aspect, the core part of the hub portion can be more reliably supported, which is advantageous for maintaining stable rotation of the impeller.

In the rotary machine according to several possible aspects, the penetrating shaft portion has a cylindrical main circular portion disposed closer to the fastening reception portion side than the non-circular portion with an outer periphery facing the inner peripheral surface of the impeller, and the connecting portion is separated from the main circular portion. When the impeller is attached to the rotary shaft with the fastening portion, the impeller is sandwiched between the fastening portion and the fastening reception portion. In the present aspect, the connecting portion is separated from the main circular portion, and thus the sandwiched state of the impeller is stably maintained practically without the connecting portion engaging with the main circular portion.

In the rotary machine according to several possible aspects, the impeller has an end surface abutting against the fastening portion, and the end surface is separated from a root part of the tip shaft portion on the penetrating shaft portion side. The fastening portion sandwiches the impeller by being screwed to the tip shaft portion and abutting against the end surface of the impeller. In the present aspect, the end surface of the impeller is separated from the root part of the tip shaft portion on the penetrating shaft portion side, and thus the fastening portion abutting against the end surface of the impeller is likely to receive practically no engagement from the penetrating shaft portion, which is advantageous for maintaining stable rotation of the impeller.

An aspect of the present disclosure relates to a rotary machine including a resinous impeller, a rotary shaft penetrating the resinous impeller, and a fastening portion fastening the impeller by being screwed to the rotary shaft, in which the rotary shaft transmits a rotational force to the impeller by engagement with the impeller in a rotational direction. In the present aspect, the rotary shaft engages with the impeller and transmits the rotational force once the rotary shaft rotates. In other words, the impeller is capable of receiving a rotational force by engagement with the rotary shaft as well as a fastening force from the fastening portion, which is suitable for stably maintaining rotation of the resinous impeller.

Hereinafter, an embodiment of the present disclosure will be described with reference to accompanying drawings. In the description of the drawings, the same reference numerals will be used to refer to the same elements so that the same description is not repeated.

An electric supercharger (rotary machine) 1 according to a first embodiment will be described with reference to FIG. 1. As illustrated in FIG. 1, the electric supercharger 1 is applied to an internal combustion engine of a vehicle, a ship, or the like. The electric supercharger 1 is provided with a compressor 7. The electric supercharger 1 compresses a fluid such as air and generates compressed air by rotating a compressor impeller 8 by means of an interaction between a rotor portion 13 and a stator portion 14.

The electric supercharger 1 is provided with a rotary shaft 12 rotatably supported in a housing 2 and the compressor impeller 8 attached to the tip side of the rotary shaft 12. The housing 2 is provided with a motor housing 3 storing the rotor portion 13 and the stator portion 14, an end wall 4 closing the rear surface side (right side in FIG. 1) opening of the motor housing 3, and a compressor housing 6 attached to the front surface side (left side in FIG. 1) of the motor housing 3 and storing the compressor impeller 8. The compressor housing 6 includes a suction port 9, a scroll portion 10, and a discharge port (not illustrated).

The compressor impeller 8 is made of, for example, resin or carbon fiber reinforced plastic (hereinafter, referred to as "CFRP"). Weight reduction has been attempted based thereon.

The rotor portion 13 is fixed to the rotary shaft 12 and includes one or a plurality of permanent magnets (not illustrated) attached to the rotary shaft 12. The stator portion 14 is fixed to the inner surface of the motor housing 3 to surround the rotor portion 13 and includes a coil portion (not illustrated) around which a conducting wire is wound. Once an alternating current flows to the coil portion of the stator portion 14 through the conducting wire, the rotary shaft 12 and the compressor impeller 8 rotate together as a result of the interaction between the rotor portion 13 and the stator portion 14. Once the compressor impeller 8 rotates, the compressor impeller 8 suctions outside air through the suction port 9, compresses the air through the scroll portion 10, and discharges the air from the discharge port. The compressed air discharged from the discharge port is supplied to the above-mentioned internal combustion engine.

The electric supercharger 1 is provided with a pair of front and rear ball bearings 20A and 20B rotatably supporting the rotary shaft 12. The ball bearing 20A on the front side is inserted (for example, press-fitted) from the tip side of the rotary shaft 12, the ball bearing 20B on the rear side is inserted (for example, press-fitted) from the base end side of the rotary shaft 12, and each of the ball bearings 20A and 20B is attached at a predetermined position as a result. The rotary shaft 12 is supported by the pair of ball bearings 20A and 20B on both sides. The ball bearings 20A and 20B are, for example, grease lubrication-type radial ball bearings. More specifically, the ball bearings 20A and 20B may be deep groove ball bearings or angular ball bearings. The ball bearings 20A and 20B include an inner ring 20*a* press-fitted into the rotary shaft 12 and an outer ring 20*b* capable of rotating relative to the inner ring 20*a* via a plurality of balls 20*c*.

The rotary shaft 12 is provided with a main shaft portion 21 where the rotor portion 13 is disposed, an impeller shaft portion 22 to which the compressor impeller 8 is attached, and a fastening reception portion 25 disposed between the main shaft portion 21 and the impeller shaft portion 22 and fulfilling a positioning function for the ball bearing 20A on the front side. Provided in the impeller shaft portion 22 are a penetrating shaft portion 26 penetrating the compressor impeller 8 and a male screw portion (tip shaft portion) 27 protruding from the compressor impeller 8. A fastening nut (fastening portion) 31 is screwed to the male screw portion 27 so that the compressor impeller 8 is attached to the rotary shaft 12. The compressor impeller 8 is mounted on the rotary shaft 12 by clearance fitting, intermediate fitting, interference fitting, or the like. In addition, the compressor impeller 8 is attached to the rotary shaft 12 by being sandwiched between the fastening reception portion 25 and the fastening nut 31 via the ball bearing 20A as a result of tightening of the fastening nut 31 screwed to the male screw portion 27.

The penetrating shaft portion 26 (refer to FIG. 2) is provided with a cylindrical main circular portion 26*a* facing an inner peripheral surface 44 of a hub portion 40 of the compressor impeller 8 and a non-circular portion 26*b* disposed closer to the male screw portion 27 side than the main circular portion 26*a*. The outline of the cross section of the main circular portion 26*a* that is orthogonal to a rotational axis S (refer to FIG. 3) has a circular shape along a virtual perfect circle C about the rotational axis S. On the other hand, the outline of the cross section of the non-circular portion 26*b* that is orthogonal to the rotational axis S has a non-circular shape deviating from the above-mentioned virtual perfect circle C. More specifically, two-side machining is performed on the non-circular portion 26*b* (refer to FIG. 3) and a pair of planar portions 26*c* substantially parallel to each other are disposed at positions line-symmetrical with respect to the rotational axis S. The planar portion 26*c* has an outline in which the virtual perfect circle C is partially cut out. The pair of planar portions 26*c* are an example of a plurality of locking portions disposed at regular intervals in a circumferential direction R of the rotary shaft 12.

Figure 2:
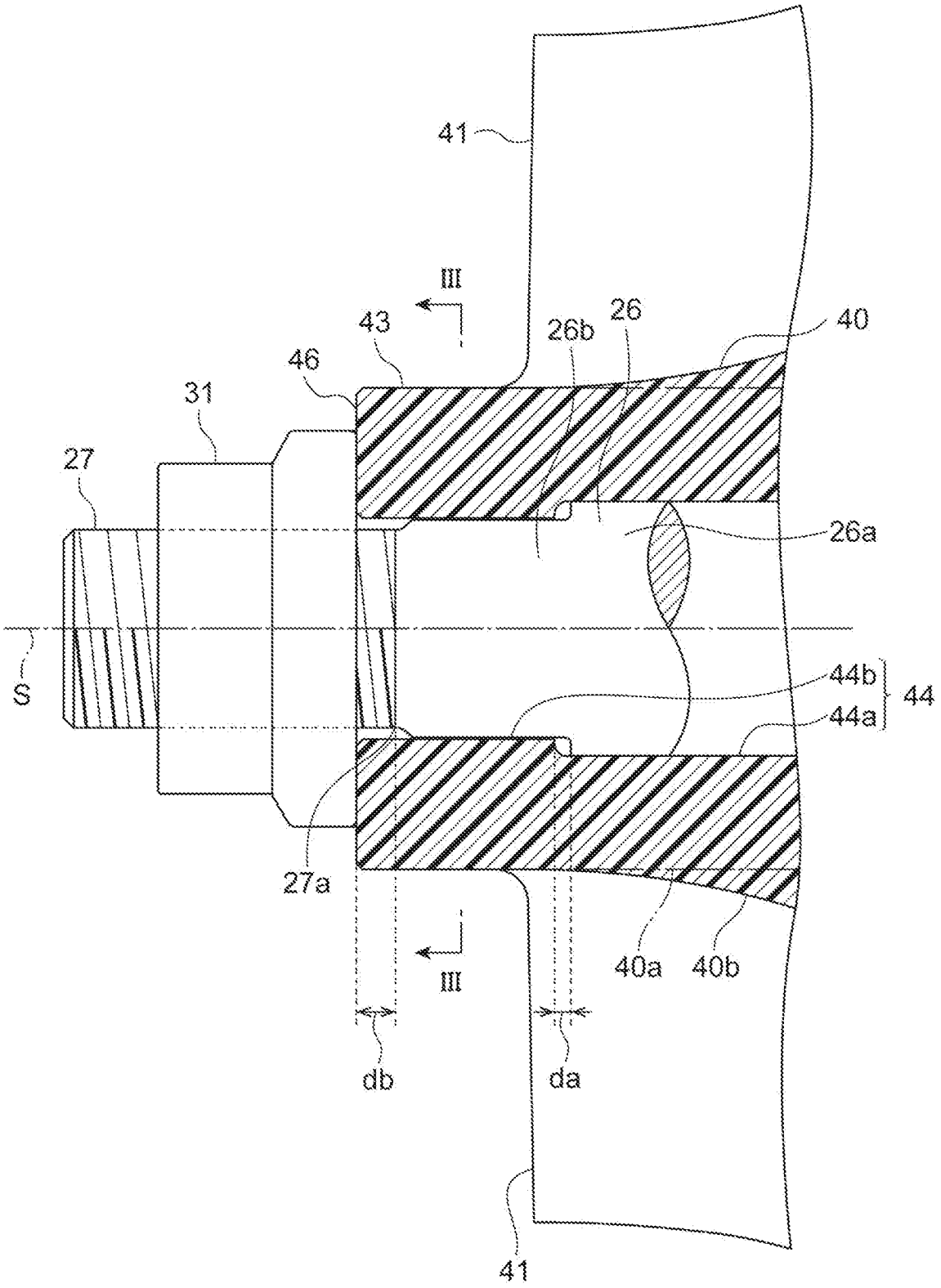
FIG. 2 is a cross-sectional view in which the tip side part of the rotary shaft illustrated in FIG. 1 is illustrated in an enlarged manner.
Figure 4:
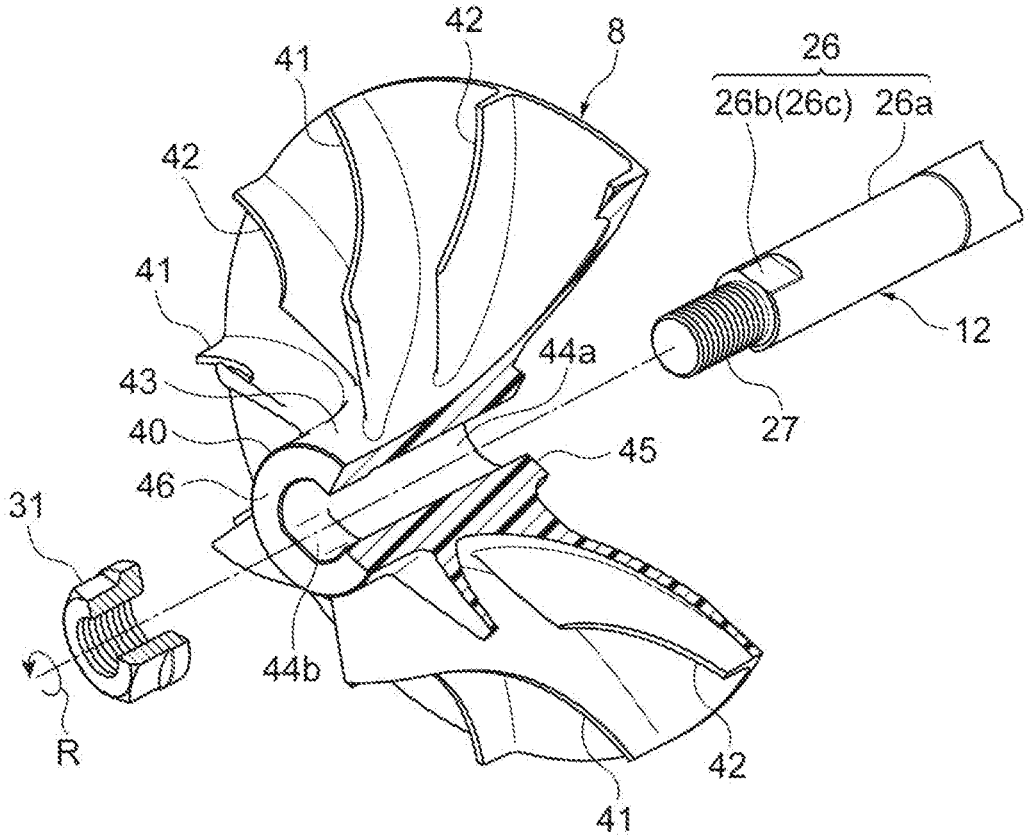
FIG. 4 is a diagram in which the impeller attached to the rotary shaft is illustrated in a partially broken manner, in which FIG. 4(*a*) is an exploded perspective view and FIG. 4(*b*) is an assembly drawing.
Figure 4:
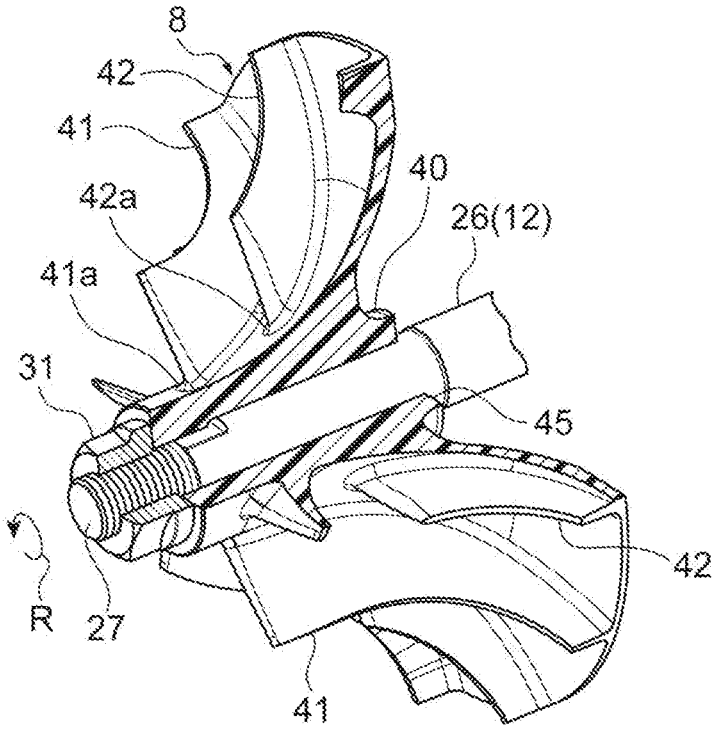

As illustrated in FIGS. 2 and 4, the compressor impeller 8 is provided with the hub portion 40 surrounding the penetrating shaft portion 26 and a plurality of long blade portions 41 and plurality of short blade portions 42 disposed on the hub portion 40. The plurality of long blade portions 41 and the plurality of short blade portions 42 are alternately disposed along the circumferential direction R of the rotary shaft 12. Comparing the roots of the long blade portion 41 and the short blade portion 42 standing up from the hub portion 40, an end portion 41*a* of the long blade portion 41 on the fastening nut 31 side is positioned closer to the fastening nut 31 than an end portion 42*a* of the short blade portion 42 on the fastening nut 31 side.

The main circular portion 26*a* of the penetrating shaft portion 26 extends at least from a rear end surface (end portion) 45 of the hub portion 40 on the fastening reception portion 25 side to a position beyond the short blade portion 42 (refer to FIG. 1). This position beyond the short blade portion 42 means that the end portion of the main circular portion 26*a* on the fastening nut 31 side is disposed at a position closer to the male screw portion 27 than the end portion 42*a* of the short blade portion 42 on the fastening nut 31 side in a direction X along the rotational axis S. This includes the end portion of the main circular portion 26*a* on the fastening nut 31 side being positioned between the end portion 42*a* and the male screw portion 27 in the direction X along the rotational axis S. The main circular portion 26*a* according to the present embodiment extends to the fastening reception portion 25 beyond the rear end surface 45 of the hub portion 40, and the dimension range of the main circular portion 26*a* in the direction X along the rotational axis S is indicated by Dx in FIG. 1.

The hub portion 40 is provided with a blade base portion 40*b* integrally disposed with respect to a cylindrical portion 40*a* penetrated by the penetrating shaft portion 26 and spreading in the radial direction of the rotary shaft 12, and the long blade portion 41 and the short blade portion 42 are disposed on an outer peripheral surface 43 continuous from the cylindrical portion 40*a* to the blade base portion 40*b*. In addition, the hub portion 40 is provided with the inner peripheral surface 44 allowing the rotary shaft 12 to be inserted, the rear end surface 45 in contact with the ball bearing 20A, and a front end surface 46 abutting against the fastening nut 31. The inner peripheral surface 44 of the hub portion 40 is an example of the inner peripheral surface of the impeller according to the present embodiment.

The inner peripheral surface 44 is provided with a circumferential surface portion 44*a* facing the main circular portion 26*a* of the penetrating shaft portion 26 (rotary shaft 12) and a non-circumferential surface portion (connecting portion) 44*b* facing the non-circular portion 26*b* of the rotary shaft 12. The non-circumferential surface portion 44*b* is formed closer to the front end surface 46 side than the circumferential surface portion 44*a*. The non-circumferential surface portion 44*b* engages with the non-circular portion 26*b* of the rotary shaft 12. This engagement means a structure in which rotation of the non-circular portion 26*b* is transmitted to the non-circumferential surface portion 44*b*, even if no friction occurs on the contact surfaces of both, by the non-circumferential surface portion 44*b* being caught by the non-circular portion 26*b*.

The non-circumferential surface portion 44*b* (refer to FIG. 3) is provided with a planar reception portion 44*c* in contact with the planar portion 26*c* of the non-circular portion 26*b*. More specifically, the non-circumferential surface portion 44*b* is provided with a pair of the planar reception portions 44*c* respectively facing the pair of planar portions 26*c* at positions line-symmetrical with respect to the rotational axis S. The outline of the cross section of the non-circumferential surface portion 44*b* that is orthogonal to the rotational axis S has a substantially oval shape that has a pair of linear parts bulging inwards with respect to the virtual perfect circle C (two-dot chain line in FIG. 3) about the rotational axis S, and the pair of linear parts correspond to the pair of planar reception portions 44*c*. The pair of planar reception portions 44*c* correspond to the pair of planar portions 26*c* and are an example of a plurality of locking reception portions disposed at regular intervals in the circumferential direction R of the rotary shaft 12.

In a state where the rear end surface 45 of the hub portion 40 is in contact with the ball bearing 20A, the non-circumferential surface portion 44*b* of the hub portion 40 is separated by a slight dimension da with respect to the main circular portion 26*a* of the rotary shaft 12 (refer to FIG. 2).

In other words, when the hub portion 40 is pushed in to the position of abutment against the ball bearing 20A, the non-circumferential surface portion 44*b* of the hub portion 40 does not interfere with the main circular portion 26*a* of the rotary shaft 12 and does not disturb the rear end surface 45 of the hub portion 40 reaching the ball bearing 20A. As a result, when the compressor impeller 8 is assembled to the rotary shaft 12, the compressor impeller 8 can be pushed in all the way (to the position of abutment against the ball bearing 20A) and reliably installed. In addition, also in a state where the compressor impeller 8 is actually rotated, the sandwiched state of the compressor impeller 8 is stably maintained practically without the non-circumferential surface portion 44*b* of the hub portion 40 interfering with the main circular portion 26*a* of the rotary shaft 12.

In addition, the front end surface 46 of the hub portion 40 is designed to be separated by a slight dimension db with respect to a root part 27*a* of the male screw portion 27. The root part 27*a* of the male screw portion 27 is the boundary part between the penetrating shaft portion 26 and the male screw portion 27. Accordingly, the front end surface 46 of the hub portion 40 remains separated from the penetrating shaft portion 26 when the compressor impeller 8 is tightened by the fastening nut 31 being screwed to the male screw portion 27 and in a state where the compressor impeller 8 is attached by tightening.

The fastening nut 31 abuts against the front end surface 46 of the hub portion 40 by being screwed to the male screw portion 27 and pushes the compressor impeller 8 in. As a result, the fastening nut 31 sandwiches the compressor impeller 8 between the fastening nut 31 and the fastening reception portion 25 via the ball bearing 20A. Although the compressor impeller 8 is indirectly sandwiched via the ball bearing 20A between the fastening nut 31 and the fastening reception portion 25 in the present embodiment, the compressor impeller 8 may also be directly sandwiched between the fastening nut 31 and the fastening reception portion 25 by a bearing supporting the rotary shaft 12 being disposed in another place. In addition, the direction of screwing of the fastening nut 31 and the male screw portion 27 can be any direction. For example, a screw may be formed and screwed in the direction opposite to the rotational direction of the compressor impeller 8. During an operation for sending out air, the compressor impeller 8 receives a fluid force in the direction opposite to the rotational direction of the compressor impeller 8. Accordingly, when a screw with a fastening direction opposite to the rotational direction is formed, for example, a fluid force to the compressor impeller 8 is generated in the direction in which the screw is tightened, and thus a decline in impeller fastening force (holding force) can be prevented.

Figure 5:
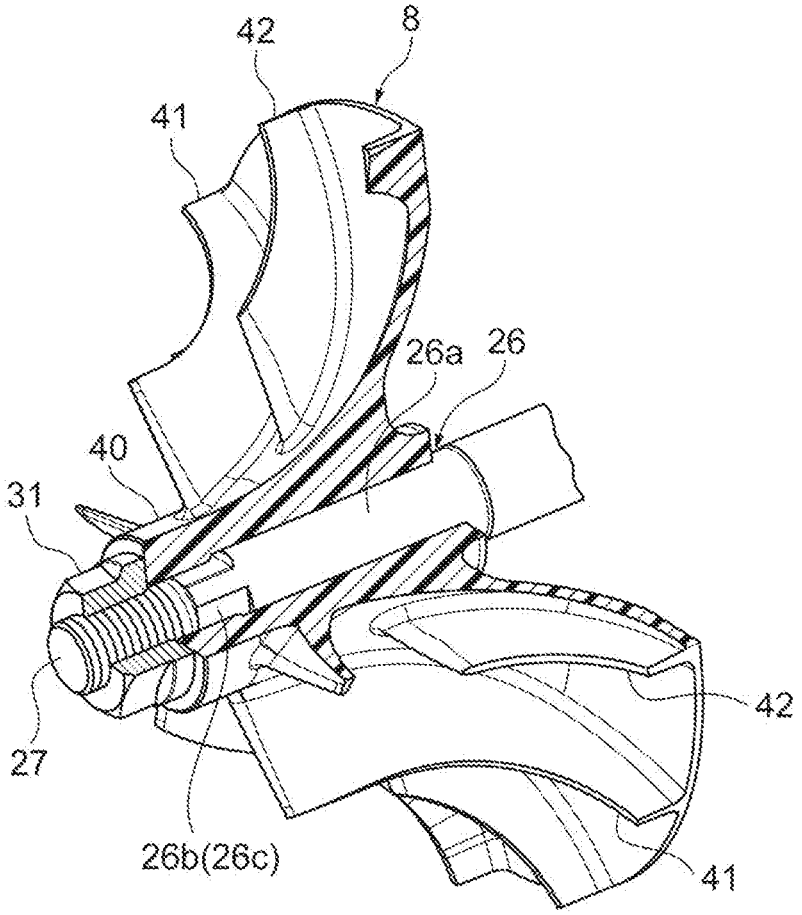
FIG. 5 is a diagram in which the rotary shaft and the impeller attached to the rotary shaft according to the present embodiment and a modification example are illustrated in a partially broken manner, in which FIG. 5(*a*) is a perspective view illustrating an assembled state, FIG. 5(*b*) is a perspective view illustrating a part of the rotary shaft, and FIG. 5(*c*) is an end view in which a non-circular portion of the rotary shaft and a non-circumferential surface portion of a hub portion are cut in a cross section orthogonal to the rotational axis.
Figure 5:
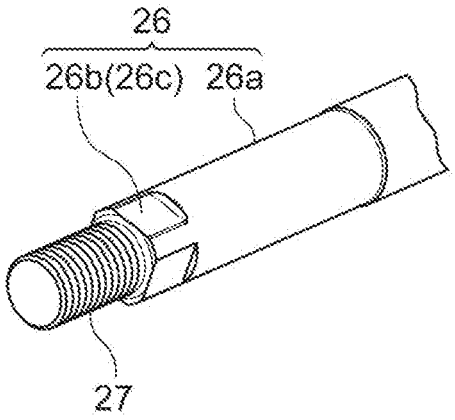
Figure 5:
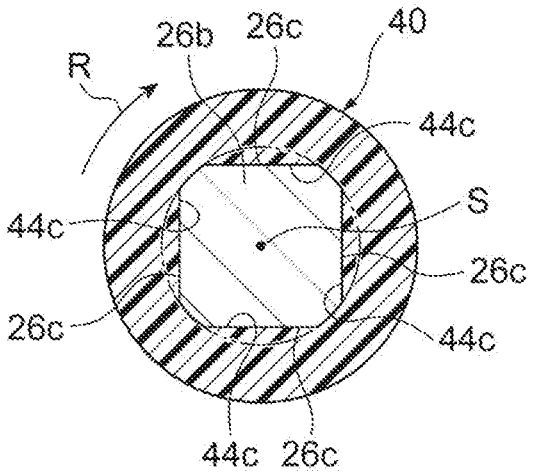

The above is a basic example. Hereinafter, a modification example of the non-circular portion 26*b* of the rotary shaft 12 and the non-circumferential surface portion 44*b* of the hub portion 40 will be described with reference to FIG. 5. The rotary shaft and the compressor impeller attached to the rotary shaft are illustrated in a partially broken manner in FIG. 5, in which FIG. 5(*a*) is a perspective view illustrating an assembled state, FIG. 5(*b*) is a perspective view illustrating a part of the rotary shaft, and FIG. 5(*c*) is an end view in which the place of connection between the non-circular portion of the rotary shaft and the non-circumferential surface portion of the hub portion is cut in the cross section orthogonal to the rotational axis.

Two sets of the pair of planar portions (locking portions) 26*c* deviating from the perfect circle C are disposed in the present modification example, and each set of the pair of planar portions 26*c* is disposed to be line-symmetrical with respect to the rotational axis S. In other words, in the present modification example, the planar portion 26*c* is disposed in four places in total, and four planar reception portions 44*c* are disposed in the hub portion 40 of the compressor impeller 8 to correspond to the four planar portions 26*c*. The four planar portions 26*c* and the four planar reception portions 44*c* are disposed at regular intervals in the circumferential direction R of the rotary shaft 12.

The action and effect of the electric supercharger 1 according to the embodiment including the basic example and the modification example described above will be described below. In a conventional aspect in which, for example, a resinous impeller is attached to a rotary shaft by nut fastening, a high-pressure fastening force (axial force) persistently acts on the impeller depending on operation situations and creep deformation (also referred to as creep distortion) is more likely to occur than in a metallic impeller. In addition, depending on the type of resin, creep deformation in a case where, for example, a resinous member is fastened, gradually increases with time and sharply increases in a predetermined time. Once the creep deformation increases, the nut loosens, the fastening force weakens, and the impeller may idle as a result. In other words, the impeller receives a fluid force in the direction opposite to the rotational direction during an operation and the relative position of the impeller with respect to the rotary shaft may deviate in the rotational direction or the radial direction. This may result in unstable rotation, that is, an increase in unbalance amount as a rotating body leading to an increase in whirling amount attributable to rotational eccentricity.

In the present embodiment, the non-circular portion 26*b* of the penetrating shaft portion 26 and the non-circumferential surface portion 44*b* of the compressor impeller 8 engage with each other and a rotational force is transmitted once the rotary shaft 12 rotates. In other words, the compressor impeller 8 is capable of receiving a rotational force from the non-circular portion 26*b* and the non-circumferential surface portion engaging with each other as well as the fastening nut 31. This engagement between the non-circular portion 26*b* and the non-circumferential surface portion 44*b* is a relationship of mutual engagement in the rotational direction of the rotary shaft 12 and, for example, the impact of creep deformation generated in the direction X along the rotational axis S is unlikely to be received with respect to the compressor impeller 8. As a result, the rotational force from the rotary shaft 12 is transmitted to the compressor impeller 8 via the non-circular portion 26*b* and the non-circumferential surface portion 44*b* even if creep deformation occurs in the resinous compressor impeller 8, and thus idling of the resinous compressor impeller 8 can be prevented, which is suitable for stably maintaining rotation and advantageous for service life extension.

Figure 3:
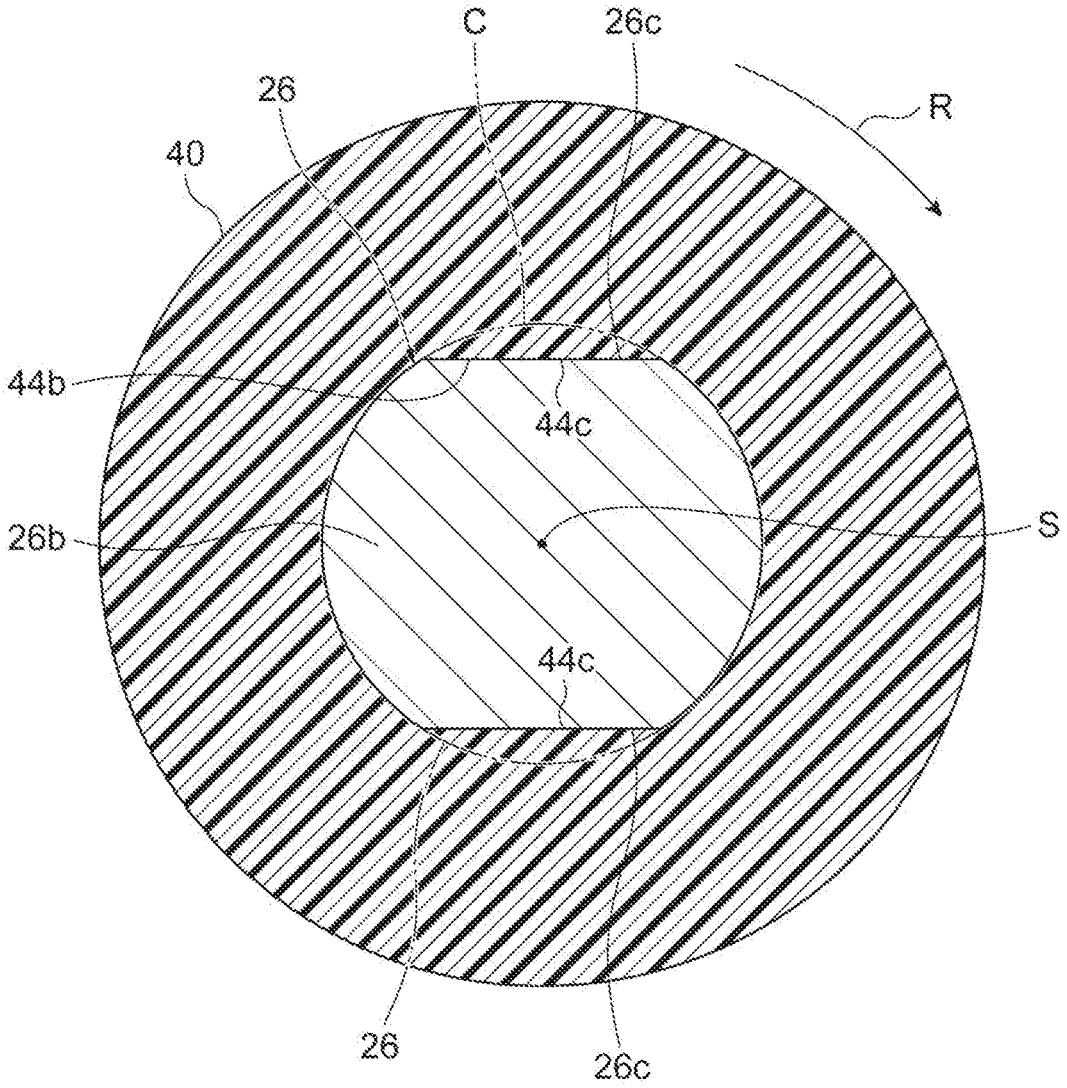
FIG. 3 is a cross-sectional view taken along line III-III of FIG. 2 and a cross-sectional view in which an impeller attached to the rotary shaft is cut along a plane orthogonal to a rotational axis.

In addition, the non-circular portion 26*b* is provided with the plurality of planar portions 26*c* deviating from the perfect circle C and the plurality of planar portions 26*c* are disposed at regular intervals in the circumferential direction R of the rotary shaft 12. For example, in the present embodiment, the planar portions 26*c* are formed in evenly spaced two places with a rotational angle of 180° as illustrated in FIG. 3. In addition, the non-circumferential surface portion 44*b* of the hub portion 40 is provided with the plurality of planar reception portions 44*c* in contact respectively with the plurality of planar portions 26*c* and the plurality of planar reception portions 44*c* are disposed at regular intervals in the circumferential direction R of the rotary shaft 12. For example, in the present embodiment, the planar reception portions 44*c* are formed in evenly spaced two places with a rotational angle of 180° as illustrated in FIG. 3. By the plurality of planar portions 26*c* and the plurality of planar reception portions 44*c* being disposed at regular intervals in the circumferential direction R of the rotary shaft 12, an increase in unbalance amount as a rotating body can be reduced and an increase in whirling amount attributable to rotational eccentricity can be prevented. As a result, rotation of the compressor impeller 8 is stably and suitably maintained.

In addition, the main circular portion 26*a* of the penetrating shaft portion 26 of the rotary shaft 12 extends at least from the rear end surface 45 of the hub portion 40 to the position beyond the short blade portion 42. The long blade portion 41 also is disposed, to alternate in the circumferential direction R of the rotary shaft 12, at the part of the hub portion 40 where the short blade portion 42 is disposed, and the part where both the short blade portion 42 and the long blade portion 41 are alternately disposed can also be referred to as the core part of the hub portion 40. In the present embodiment, the entire core part of the hub portion 40 is supported by the cylindrical main circular portion 26*a*. As a result, the core part of the hub portion 40 can be more reliably supported by the main circular portion 26*a*, which is advantageous for maintaining stable rotation of the compressor impeller 8.

In addition, the non-circumferential surface portion 44*b* of the hub portion 40 is designed to be separated in the direction X along the rotational axis S with respect to the main circular portion 26*a* of the rotary shaft 12. When the compressor impeller 8 is attached to the rotary shaft 12 with the fastening nut 31, the compressor impeller 8 is sandwiched between the fastening nut 31 and the fastening reception portion 25. In the present embodiment, the non-circumferential surface portion 44*b* is separated from the main circular portion 26*a*, and thus the sandwiched state of the compressor impeller 8 is stably maintained practically without the non-circumferential surface portion 44*b* interfering with the main circular portion 26*a*.

In addition, the hub portion 40 has the front end surface 46 abutting against the fastening nut 31 and the front end surface 46 is separated from the root part 27*a* of the male screw portion 27 on the penetrating shaft portion 26 side. Accordingly, the fastening nut 31 abutting against the front end surface 46 remains separated from the penetrating shaft portion 26 when the fastening nut 31 is tightened and in a state where the compressor impeller 8 is attached by tightening. As a result, the fastening nut 31 is likely to receive practically no interference from the penetrating shaft portion 26, which is advantageous for maintaining stable rotation of the compressor impeller 8. In addition, the amount by which the non-circumferential surface portion 44*b* of the hub portion 40 and the main circular portion 26*a* of the rotary shaft 12 are separated from each other can be a distance at which no abutting occurs even if creep defamation occurs during an operation of the compressor impeller 8, examples of which include approximately several millimeters.

The present invention can be implemented in various forms changed and improved based on the above-described embodiment and the knowledge of those skilled in the art. In addition, modification examples can be appropriately configured and reference forms to be described below can be appropriately combined by means of the technical matters described in the above embodiment.

For example, the non-circular portion of the rotary shaft has only to deviate from the virtual perfect circle about the rotational axis and be capable of receiving rotational force transmission in contact with at least the connecting portion of the impeller. Accordingly, the shape of the cross section that is orthogonal to the rotational axis may also be an elliptical shape, a polygonal shape, or any other irregular shape without having to be limited to the embodiment and the modification example described above, and the shape may also be a shape that has, for example, a pin-shaped projection protruding outwards from the virtual perfect circle.

In addition, the structure of the present invention is applicable to every rotary machine in which a resinous impeller is attached to a rotary shaft by fastening of a fastening portion. For example, the present invention can be applied to an electric supercharger provided with a turbine and a motor supporting rotation and can be applied to a non-electric supercharger in general. The present invention can also be applied to a generator performing turbine-based electric power generation without having to be limited to a rotary machine provided with a compressor.

Figure 6:
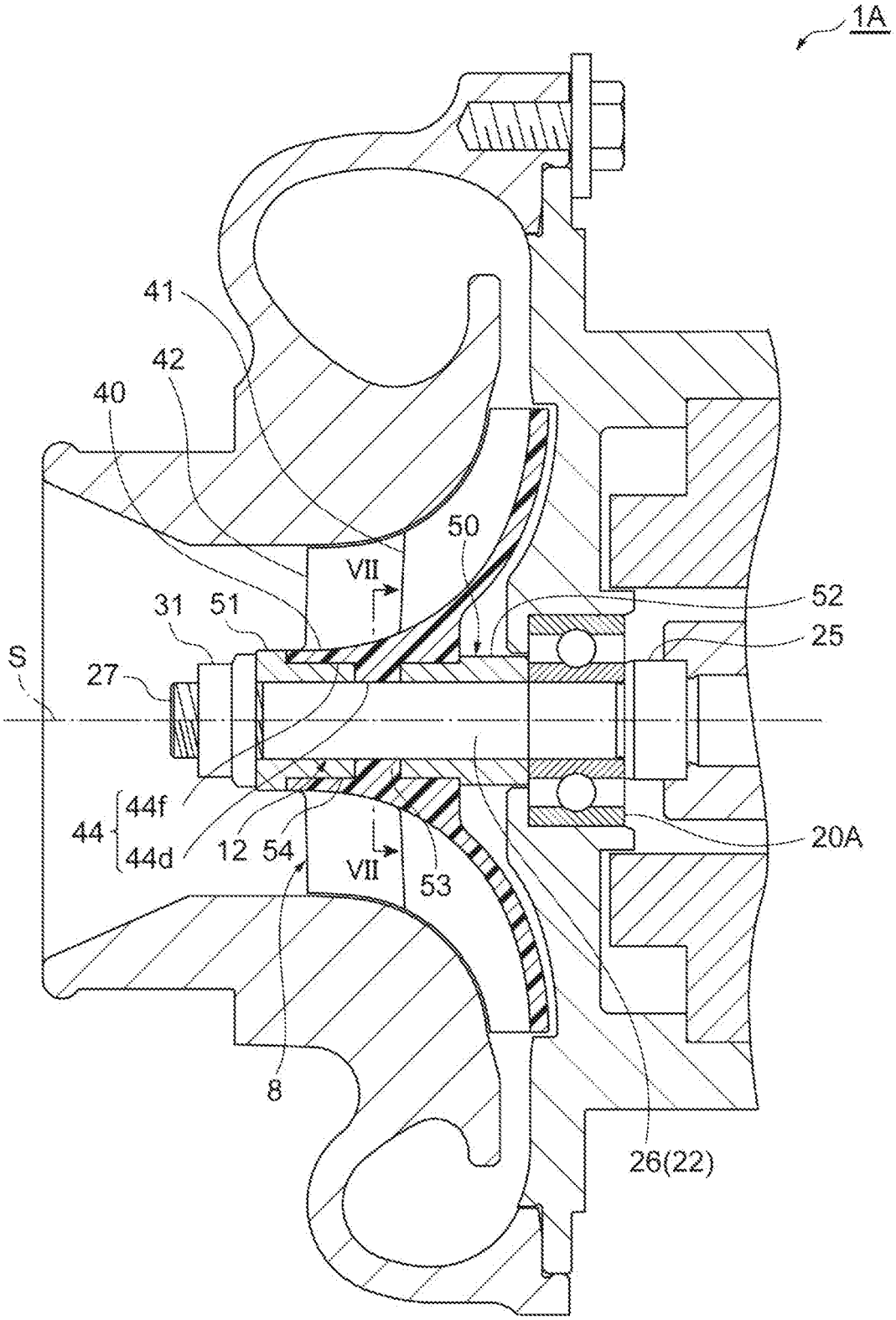
FIG. 6 is a cross-sectional view illustrating the tip side part of a rotary shaft according to a first reference form.
Figure 7:
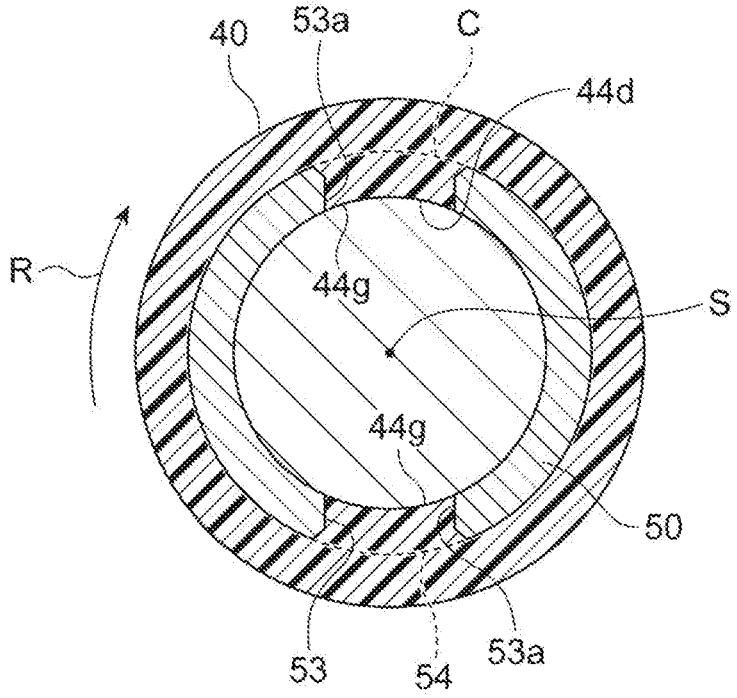
FIG. 7 is an end view of the cross section taken along line VII-VII of FIG. 6.
Figure 8:
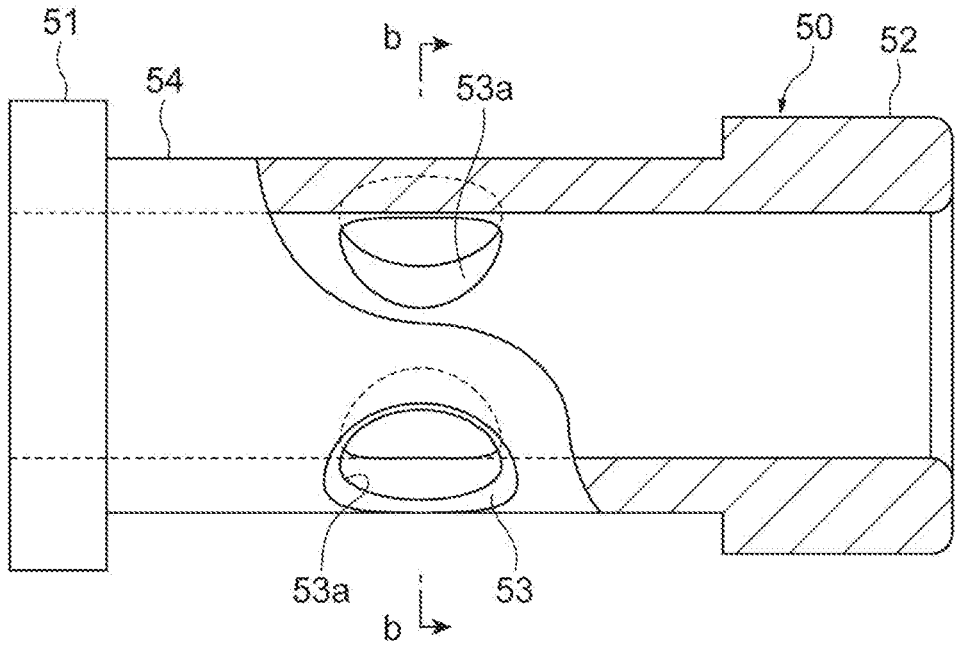
FIG. 8 is a diagram illustrating a sleeve, in which FIG. 8(*a*) is a side view and FIG. 8(*b*) is a cross-sectional view taken along line b-b of FIG. 8(*a*).
Figure 8:
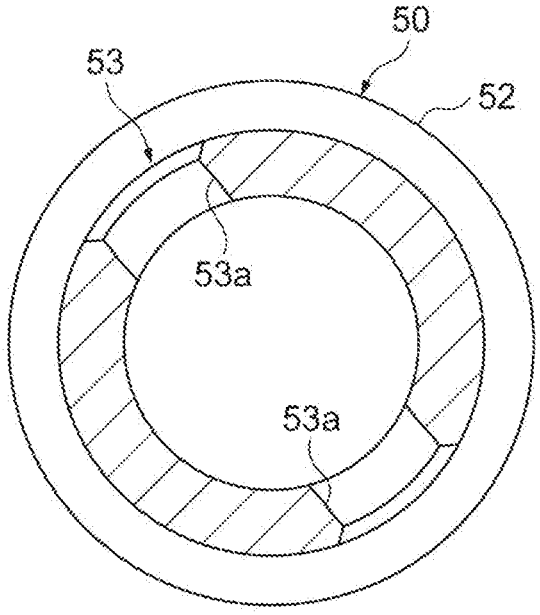

Hereinafter, an electric supercharger (rotary machine) 1A according to a first reference form will be described with reference to FIGS. 6, 7, and 8. FIG. 6 is a cross-sectional view illustrating a part of the tip side of the rotary shaft according to the first reference form. FIG. 7 is an end view of the cross section taken along line VII-VII of FIG. 6. A sleeve is illustrated in FIG. 7, in which FIG. 7(*a*) is a side view and FIG. 7(*b*) is a cross-sectional view taken along line b-b of FIG. 7(*a*).

As described above, in the conventional rotary machine, the impeller attached to the rotary shaft with a nut is made of resin, and thus the impeller is more likely to undergo creep deformation with time than a metallic impeller. As a result, the impeller idles depending on operation situations, and then unstable rotation occurs in some cases. An object of the invention according to the present reference form is to provide a rotary machine suitable for stably maintaining the rotation of a resinous impeller.

In other words, the fluid-transferring electric supercharger (rotary machine) 1A according to the first reference faun is provided with the resinous compressor impeller (impeller) 8 transferring a fluid by rotation, the rotary shaft 12 penetrating the compressor impeller 8, a sleeve 50 disposed between the compressor impeller 8 and the rotary shaft 12, and the fastening nut (fastening portion) 31 screwed to the rotary shaft 12 and pressure joined to, that is, abutting with pressure applied against an end portion 51 of the sleeve 50. The rotary shaft 12 is provided with the fastening reception portion 25, and the fastening nut (fastening portion) 31 sandwiches the sleeve 50 between the fastening nut (fastening portion) 31 and the fastening reception portion 25.

The sleeve 50 is provided with a non-circular pipe portion 53, the outline of the cross section of the non-circular pipe portion 53 that is orthogonal to the rotational axis S deviates from the perfect circle C about the rotational axis S, and the non-circular pipe portion 53 is provided with a plurality of hole portions (locking reception portions) 53*a*. In addition, the compressor impeller 8 is provided with a non-circumferential surface portion 44*d* engaging with the non-circular pipe portion 53, and the non-circumferential surface portion 44*d* is provided with a plurality of locking projection portions (locking portions) 44*g* fitted into the plurality of hole portions 53*a*. In the present reference form, each of the plurality of hole portions 53*a* and the plurality of locking projection portions 44*g* is formed at regular intervals along the circumferential direction R of the rotary shaft 12.

The first reference form will be described in more detail below. The electric supercharger 1A according to the first reference form is provided with elements and structures similar to those of the electric supercharger 1 according to the above-described embodiment. Accordingly, the following description will focus on differences and the same reference numerals will be used to refer to the similar elements and structures so that detailed description thereof is omitted.

As in the case of the above-described embodiment, the electric supercharger 1A (refer to FIGS. 1 and 6) compresses a fluid such as air and generates compressed air by rotating the compressor impeller 8 by means of an interaction between the rotor portion 13 and the stator portion 14. The electric supercharger 1A is provided with the rotary shaft 12 rotatably supported in the housing 2 and the sleeve 50 integrally molded in the resinous compressor impeller 8 and mounted on the rotary shaft 12.

The rotary shaft 12 is provided with the main shaft portion 21 (refer to FIG. 1), the impeller shaft portion 22, and the fastening reception portion 25. The impeller shaft portion 22 is provided with the penetrating shaft portion 26 inserted into the sleeve 50 and the male screw portion (tip shaft portion) 27 protruding from the sleeve 50. The fastening nut 31 is screwed to the male screw portion 27. The fastening nut 31 screwed to the male screw portion 27 is pressure joined to, that is, abuts with pressure applied against the sleeve 50. As a result, the sleeve 50 is sandwiched between the fastening reception portion 25 and the fastening nut 31 via the ball bearing 20A and attached to the rotary shaft 12. The sleeve 50 is integrally molded in the compressor impeller 8. Accordingly, attachment of the sleeve 50 to the rotary shaft 12 results in attachment of the compressor impeller 8 to the rotary shaft 12.

The sleeve 50 is made of metal such as carbon steel unlikely to be affected by creep deformation and is integrally molded in the resinous compressor impeller 8 during injection molding. The end portion 51 and the other end portion 52 of the sleeve 50 are thick parts protruding in a flange shape. The end portion 51 abuts against the fastening nut 31, and the other end portion 52 abuts against the ball bearing 20A on the fastening reception portion 25 side. In addition, the sleeve 50 is provided with a cylindrical circular pipe portion 54 inscribed in the hub portion 40 of the compressor impeller 8 and the non-circular pipe portion 53.

The outline of the cross section of the circular pipe portion 54 that is orthogonal to the rotational axis S (refer to FIG. 7) has a circular shape along the virtual perfect circle C (refer to the dashed line in FIG. 7) about the rotational axis S. On the other hand, the outline of the cross section of the non-circular pipe portion 53 that is orthogonal to the rotational axis S deviates from the perfect circle C about the rotational axis S. More specifically, the non-circular pipe portion 53 is provided with the pair (plurality) of hole portions 53*a*, and the pair of hole portions 53*a* are disposed at positions line-symmetrical with respect to the rotational axis S. Although the hole portion 53*a* according to the present embodiment assumes a circular shape, the shape of the hole portion 53*a* is not limited to the circular shape and may be another shape such as a plurality of slits and a long hole along the rotational axis S. In addition, the hole portion 53*a* may be a bottomed hole without having to be limited to a through hole. In addition, one hole portion 53*a* may be provided instead of the plurality of hole portions 53*a*. In a case where the plurality of hole portions 53*a* are provided, it is desirable that the hole portions 53*a* are disposed at equal intervals in the circumferential direction R of the rotary shaft 12. Although the hole portion 53*a* is disposed in the sleeve 50 in the present reference form, also assumable is a special form in which, for example, a projection or the like is disposed on the sleeve or the tubular main body part of the sleeve has a complex shape. However, the hole portion 53*a* being disposed in the sleeve 50 as in the present reference form is normally more advantageous for improving processability, although depending on manufacturing methods, than the above-described special form.

As a result of the integral molding of the compressor impeller 8 and the sleeve 50, the plurality of locking projection portions 44*g* fitted into the hole portions 53*a* of the sleeve 50 are formed in the hub portion 40 of the compressor impeller 8. By the locking projection portion 44*g* coining into contact with the hole portion 53*a* to be fitted thereinto, the compressor impeller 8 reliably rotates in conjunction with rotation of the sleeve 50.

The action and effect of the electric supercharger 1A according to the present reference form will be described below. In the conventional aspect in which, for example, the resinous impeller is directly attached to the rotary shaft by nut fastening, a high-pressure fastening force persistently acts on the impeller depending on operation conditions and creep deformation (also referred to as creep distortion) is likely to occur. In addition, depending on the type of resin, creep deformation in a case where, for example, a resinous member is fastened, gradually increases with time and sharply increases in a predetermined time. Once the creep deformation increases, the nut loosens, the fastening force weakens, and the impeller may idle as a result. In other words, the impeller receives a fluid force in the direction opposite to the rotational direction during an operation and the relative position of the impeller with respect to the rotary shaft may deviate in the rotational direction or the radial direction. This may result in unstable rotation, that is, an increase in unbalance amount as a rotating body leading to an increase in whirling amount attributable to rotational eccentricity.

In the present reference form, the fastening nut 31 abuts mainly against not the resinous compressor impeller 8 but the end portion 51 of the sleeve 50. In other words, the sleeve 50 is firmly sandwiched between the fastening nut 31 and the fastening reception portion 25 as a result of fastening of the fastening nut 31. Since the sleeve 50 is metallic, the impact on creep deformation or the like is smaller than in resin even in the event of firm tightening by means of the fastening nut 31, and thus the rotational force of the rotary shaft 12 is stably transmitted to the sleeve 50. Furthermore, the rotational force of the sleeve 50 is transmitted to the compressor impeller 8 by engagement between the hole portion 53*a* of the sleeve 50 and the locking projection portion 44*g* of the hub portion 40. In addition, the engagement between the hole portion 53*a* and the locking projection portion 44*g* also is unlikely to be affected by creep deformation or the like. In other words, the electric supercharger 1A according to the present reference form is suitable for stably maintaining rotation of the resinous compressor impeller 8 and advantageous for service life extension.

Although the hole portion 53*a* of the sleeve 50 is an example of a locking reception portion, the locking reception portion has only to be a part with an outline deviating from the perfect circle C about the rotational axis S and may also be a pin-shaped projection or the like. In addition, although the locking projection portion 44*g* of the hub portion 40 is an example of a locking portion corresponding to the locking reception portion, the locking projection portion 44*g* may also be, for example, a hole into which the pin-shaped projection or the like is fitted in a case where the locking reception portion of the sleeve 50 is the pin-shaped projection or the like.

Figure 9:
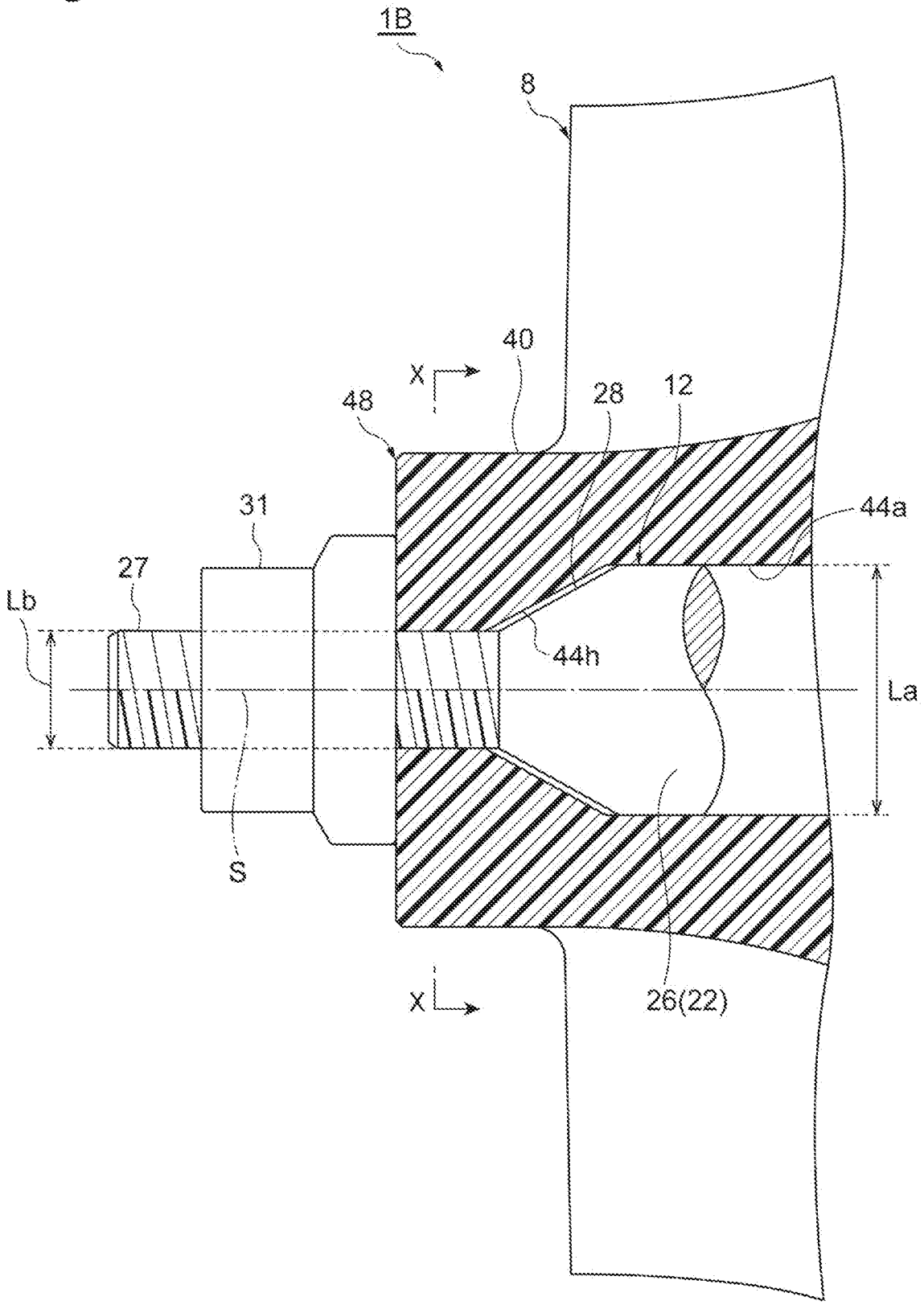
FIG. 9 is a cross-sectional view in which the tip side part of a rotary shaft according to a second reference form is illustrated in an enlarged manner.
Figure 10:
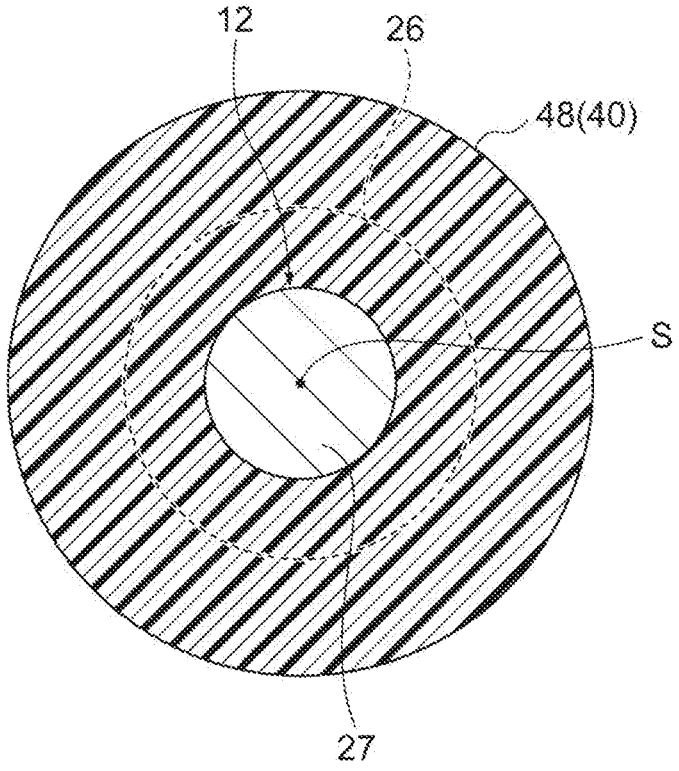
FIG. 10 is an end view of the cross section taken along line X-X of FIG. 9.

Hereinafter, an electric supercharger 1B according to a second reference form will be described with reference to FIGS. 9 and 10. FIG. 9 is a cross-sectional view in which a part of the tip side of the rotary shaft according to the second reference form is illustrated in an enlarged manner. FIG. 10 is an end view of the cross section taken along line X-X of FIG. 9.

As described above, in the conventional rotary machine, the impeller attached to the rotary shaft with a nut is made of resin, and thus the impeller is more likely to undergo creep deformation with time than a metallic impeller. As a result, the impeller idles depending on operation situations, and then unstable rotation occurs in some cases. An object of the invention according to the present reference form is to provide a rotary machine suitable for stably maintaining the rotation of a resinous impeller.

In other words, the fluid-transferring electric supercharger (rotary machine) 1B according to the second reference form is provided with the resinous compressor impeller (impeller) 8 transferring a fluid by rotation, the rotary shaft 12 penetrating the compressor impeller 8, and the fastening nut (fastening portion) 31 screwed to the rotary shaft 12. The rotary shaft 12 is provided with the penetrating shaft portion 26 facing the inner peripheral surface 44 of the compressor impeller 8, the male screw portion (tip shaft portion) 27 screwed to the fastening nut 31, and the fastening reception portion 25 (refer to FIG. 1) sandwiching the compressor impeller 8 between the fastening reception portion 25 and the fastening nut 31.

The compressor impeller 8 is provided with the circumferential surface portion 44*a* penetrated by the penetrating shaft portion 26 and a front end portion 48 penetrated by the male screw portion 27 and abutting against the fastening nut 31. An outer diameter Lb of the male screw portion 27 is smaller than an outer diameter La of the penetrating shaft portion 26. The front end portion 48 protrudes inwards, that is, to the rotational axis S side compared to the circumferential surface portion 44*a* to correspond to the reduction in the diameter of the male screw portion 27.

The second reference form will be described in more detail below. The electric supercharger 1B according to the second reference form is provided with elements and structures similar to those of the electric supercharger 1 according to the above-described embodiment. Accordingly, the following description will focus on differences and the same reference numerals will be used to refer to the similar elements and structures so that detailed description thereof is omitted.

As in the case of the above-described embodiment, the electric supercharger 1B (refer to FIGS. 1 and 9) compresses a fluid such as air and generates compressed air by rotating the compressor impeller 8 by means of an interaction between the rotor portion 13 and the stator portion 14. The electric supercharger 1B is provided with the rotary shaft 12 rotatably supported in the housing 2 and the resinous compressor impeller 8.

The rotary shaft 12 is provided with the main shaft portion 21, the impeller shaft portion 22, and the fastening reception portion 25. The impeller shaft portion 22 is provided with the penetrating shaft portion 26 and the male screw portion (tip shaft portion) 27. The outer diameter Lb of the male screw portion 27 is smaller than the outer diameter La of the penetrating shaft portion 26 and may be to the extent that a fastening farce variation (described later) can be reduced. For example, the ratio of the outer diameter Lb of the male screw portion 27 to the outer diameter La of the penetrating shaft portion 26 is approximately three to two or below. In addition, the impeller shaft portion 22 is provided with a tapered connecting shaft portion 28 for communication between the penetrating shaft portion 26 and the male screw portion 27. The connecting shaft portion 28 is disposed between the penetrating shaft portion 26 and the male screw portion 27, and the diameter of the connecting shaft portion 28 gradually decreases from the penetrating shaft portion 26 to the male screw portion 27.

The hub portion 40 of the compressor impeller 8 is provided with the circumferential surface portion 44*a* penetrated by the penetrating shaft portion 26 and the front end portion 48 penetrated by the male screw portion 27. The fastening nut 31 screwed to the male screw portion 27 is pressure joined to, that is, abuts with pressure applied against the front end portion 48. In addition, the front end portion 48 protrudes inwards, that is, to the rotational axis S side compared to the circumferential surface portion 44*a*, and a tapered diameter-enlarged hole portion 44*h* is disposed to correspond to the connecting shaft portion 28 of the impeller shaft portion 22. The diameter-enlarged hole portion 44*h* is separated from the connecting shaft portion 28 in a state where the compressor impeller 8 is attached to the rotary shaft 12 by tightening of the fastening nut 31.

The fastening nut 31 is screwed to the male screw portion 27. The outer diameter Lb of the male screw portion 27 is smaller than the outer diameter La of the penetrating shaft portion 26. In other words, the fastening nut 31 according to the present reference form is smaller in size than a fastening nut screwed to a male screw portion with the same diameter as the penetrating shaft portion 26.

The action and effect of the electric supercharger 1B according to the present reference form will be described below. In the conventional aspect in which, for example, the resinous impeller is directly attached to the rotary shaft by nut fastening, a high-pressure fastening force persistently acts on the impeller depending on operation conditions and creep deformation (also referred to as creep distortion) is likely to occur. In addition, depending on the type of resin, creep deformation in a case where, for example, a resinous member is fastened, gradually increases with time and sharply increases in a predetermined time. Once the creep deformation increases, the nut loosens, the fastening force weakens, and the impeller may idle as a result. In other words, the impeller receives a fluid force in the direction opposite to the rotational direction during an operation and the relative position of the impeller with respect to the rotary shaft may deviate in the rotational direction or the radial direction. This may result in unstable rotation, that is, an increase in unbalance amount as a rotating body leading to an increase in whirling amount attributable to rotational eccentricity.

The outer diameter Lb of the male screw portion 27 according to the present reference form is smaller than the outer diameter La of the penetrating shaft portion 26. The smaller diameter of the male screw portion 27 is advantageous for reducing the diameter of the fastening nut 31. When the fastening nut 31 has a small diameter, a variation of the generated axial force is reduced, which is practically advantageous for suppressing creep deformation. Specifically, in a case where the fastening nut 31 is fastened by the torque method by means of a predetermined tool such as a torque wrench, for example, the fastening torque value variation relatively increases as a predetermined fastening torque value decreases. Accordingly, by the diameter of the male screw portion 27 being reduced, a relatively large tightening torque value can be set with respect to a predetermined generated axial force, and the variation of the generated axial force can be reduced by means of tightening torque value variation reduction. On the other hand, when the fastening nut is reduced in size by the rotary shaft as a whole being made thin (reduced in diameter), a decline in shaft rigidity occurs and shaft vibration increases, which is unsuitable for stably maintaining rotation of the compressor impeller 8. In other words, in the present reference form, the fastening nut 31 is reduced in size by not the rotary shaft 12 as a whole but only the male screw portion 27 as a tip side part being reduced in diameter, which is suitable for stably maintaining rotation of the resinous compressor impeller 8 while maintaining shaft rigidity.

Furthermore, the front end portion 48 penetrated by the male screw portion 27 protrudes inwards, that is, to the rotational axis S side compared to the circumferential surface portion 44*a*. In other words, the fastening nut 31 reduced in diameter is pressure joined to, that is, abuts with pressure applied against the front end portion 48 (hub portion 40) with a larger contact area ensured than in an aspect without the inward protrusion, which is advantageous for firmly and stably sandwiching the compressor impeller 8 between the fastening nut 31 and the fastening reception portion 25.

Furthermore, the rotary shaft 12 according to the present reference form is provided with the connecting shaft portion 28 between the penetrating shaft portion 26 and the male screw portion 27, the front end portion 48 of the compressor impeller 8 is provided with the diameter-enlarged hole portion 44*h* corresponding to the connecting shaft portion 28, and the diameter-enlarged hole portion 44*h* is separated from the connecting shaft portion 28. As a result of this separation, the compressor impeller 8 can be pushed in all the way (to the position of abutment against the ball bearing 20A) and reliably installed, without the front end portion 48 interfering with the penetrating shaft portion 26, when the compressor impeller 8 is assembled to the rotary shaft 12. In addition, also in a state where the compressor impeller 8 is actually rotated, the sandwiched state of the compressor impeller 8 is stably maintained practically without the front end portion 48 of the hub portion 40 interfering with the penetrating shaft portion 26 of the rotary shaft 12. In addition, the amount by which the diameter-enlarged hole portion 44*h* of the hub portion 40 and the connecting shaft portion 28 of the rotary shaft 12 are separated from each other can be a distance at which no abutting occurs even if creep deformation occurs during an operation of the compressor impeller 8, examples of which include approximately several millimeters.

Although the first reference form and the second reference form have been described above, the technical content not described in these reference forms is commonly applied to the above-described embodiment in a range without contradiction. Furthermore, modification examples can be appropriately configured by means of the technical matters described in the above embodiment.

In addition, the invention according to the first reference form and the second reference form is applicable to every rotary machine in which a resinous impeller is attached to a rotary shaft by fastening of a fastening portion. For example, the present reference forms can be applied to an electric supercharger provided with a turbine and a motor supporting rotation and can be applied to a non-electric supercharger in general. The present reference forms can also be applied to a generator performing turbine-based electric power generation without having to be limited to a rotary machine provided with a compressor.

REFERENCE SIGNS LIST

1: electric supercharger (rotary machine), 8: compressor impeller, 12: rotary shaft, 25: fastening reception portion, 26: penetrating shaft portion, 26*a*: main circular portion, 26*b*: non-circular portion, 26*c*: planar portion (locking portion), 27: male screw portion (tip shaft portion), 27*a*: root part, 31: fastening nut (fastening portion), 40: hub portion, 41: long blade portion, 42: short blade portion, 43: outer peripheral surface (outer periphery), 44: inner peripheral surface (inner peripheral surface of impeller), 44*b*: non-circumferential surface portion (connecting portion), 44*c*: planar reception portion (locking reception portion), 46: front end surface (end surface), S: rotational axis, C: perfect circle, R: circumferential direction of rotary shaft.

The invention claimed is:

1. A rotary machine comprising:

a rotating resinous impeller;

a rotary shaft penetrating the impeller; and a fastening portion screwed to the rotary shaft, wherein the rotary shaft includes a penetrating shaft portion facing an inner peripheral surface of the impeller, a tip shaft portion protruding from the penetrating shaft portion, the tip shaft portion screwed to the fastening portion, and a fastening reception portion sandwiching the impeller between the fastening reception portion and the fastening portion, the penetrating shaft portion has a non-circular portion and an outline of a cross section of the non-circular portion orthogonal to a rotational axis deviates from a perfect circle about the rotational axis, the impeller includes a hub portion surrounding the penetrating shaft portion, a plurality of long blade portions, and a plurality of short blade portions, the plurality of long blade portions and the plurality of short blade portions disposed on an outer periphery of the hub portion and alternately disposed along a circumferential direction of the rotary shaft, the hub portion includes a connecting portion engaging with the non-circular portion directly, a part of the long blade portion is provided on an outer periphery of the connecting portion, the penetrating shaft portion has a cylindrical main circular portion disposed closer to a fastening reception portion side than the non-circular portion with an outer periphery facing the inner peripheral surface of the impeller, and the connecting portion is separated from the main circular portion.

2. The rotary machine according to claim 1, wherein:

a plurality of locking portions deviating from the perfect circle are disposed in the non-circular portion;

the plurality of locking portions are disposed at regular intervals in the circumferential direction of the rotary shaft;

a plurality of locking reception portions respectively engaging with the plurality of locking portions are disposed in the connecting portion; and the plurality of locking reception portions are disposed at regular intervals in the circumferential direction of the rotary shaft.

3. The rotary machine according to claim 1, wherein:

the cylindrical main circular portion extends at least from an end portion on the fastening reception portion side of the hub portion to a position surpassing the short blade portion and not surpassing the long blade portion.

4. The rotary machine according to claim 2, wherein:

the cylindrical main circular portion extends at least from an end portion on the fastening reception portion side of the hub portion to a position surpassing the short blade portion and not surpassing the long blade portion.

5. The rotary machine according to claim 1, wherein:

the impeller has an end surface abutting against the fastening portion; and the end surface is separated from a root part of the tip shaft portion on a penetrating shaft portion side.

6. The rotary machine according to claim 1, wherein:

the fastening portion abuts on the hub portion.

7. The rotary machine according to claim 1, wherein:

the connecting portion of the hub portion is separated in an axial direction from the cylindrical main circular portion when a rear end surface of the hub portion abuts a bearing supporting the rotary shaft.

8. The rotary machine according to claim 1, wherein:

a front end surface of the hub portion is separated in an axial direction from a boundary part between the penetrating shaft portion and the tip shaft portion.

* * * * *